United States Patent [19]

Crosby

[11] Patent Number: 4,815,717

[45] Date of Patent: Mar. 28, 1989

[54] SPRING ASSEMBLY FOR UPHOLSTERED FURNITURE

[75] Inventor: Lawton H. Crosby, Lake Bluff, Ill.

[73] Assignee: Morley Furniture Spring Corporation, Lake Bluff, Ill.

[21] Appl. No.: 454,861

[22] Filed: Dec. 30, 1982

[51] Int. Cl.[4] ..... F16F 1/02

[52] U.S. Cl. ..... 267/110; 5/247; 5/255; 297/452

[58] Field of Search ..... 267/103–112; 5/247, 255; 297/452

[56] References Cited

U.S. PATENT DOCUMENTS

| | | | |
|---|---|---|---|
| 2,731,075 | 1/1956 | Flint | 267/107 X |
| 2,870,823 | 1/1959 | Staples | 267/110 |
| 3,071,367 | 1/1963 | Asaro et al. | 267/107 |
| 3,276,765 | 10/1966 | Slominski et al. | 267/112 X |
| 3,790,149 | 2/1974 | Crosby . | |
| 4,228,991 | 10/1980 | Crosby | 267/111 X |

*Primary Examiner*—George E. A. Halvosa
*Attorney, Agent, or Firm*—Willian Brinks Olds Hofer Gilson & Lione Ltd.

[57] ABSTRACT

A seat spring assembly for upholstered furniture incorporates an inverted torque arm adjacent the back rail of the furniture frame. The torque arm is formed upwardly out of the body of a sinuous spring band which descends from its crown closer to the front rail, in a continuous curve, to lower end of the torque arm at a point below the level of the top of the back rail. The torque arm is connected, from its upper end to the back rail, by translatory means which include a generally horizontal link.

7 Claims, 2 Drawing Sheets

SPRING ASSEMBLY FOR UPHOLSTERED FURNITURE

FIELD OF THE INVENTION

This invention relates to upholstered furniture. It relates particularly to upholstered furniture which employs any or all of: (1) thick poly-foam wrapped cushions; (2) loose-pillow back construction; or (3) loose-cushion construction in either hard-edge or spring-edge configuration. It also relates to upholstered high-style motion furniture.

BACKGROUND OF THE INVENTION

Much has been done in the last few years to provide sophisticated springing in upholstered furniture. The inventions disclosed in U.S. Pat. Nos. 3,210,064, 3,388,904 and 3,525,514, as well as others assigned to the same assignee as the present invention, achieve high levels of comfort and luxury in full-upholstered furniture of the type which permits a high-arc profile for the seat springs. They achieve the same ends in full-upholstered furniture which, when loose cushion, uses the popular, single, thinner, flat profile, poly-foam non-wrapped cushions. Such furniture is largely tight-back rather than loose (pillow)-back. It is often tight-seat rather than loose (cushion) seat, also.

In recent years there has been an industry trend towards very thick (6"–7" or more), multi-layered, poly-foam wrapped cushions having a pronounced high-curve profile. There has also been a trend toward loose-pillow-backs; toward loose-cushion (hard-edge or spring-edge) seats and toward high-style "motion" furniture.

Such trends have created new problems. These include cushion-gap; less frame pitch, resulting in less room for comfort contributing features; less cushion-base pitch and cushion pitch; a need for the same comfort in hard-edge, loose cushion seats as was formerly achieved in spring-edge, loose cushion seats; and a need for increased yield at the front rail to balance "sink-in" at the back rail created by the new, extra-thick cushions.

In the aforedescribed new trend in furniture, internal parameters as well as style requirements make the use of normally high-arc springs (even with the superior seat luxury associated with them) undesirable. This is because of the necessity of maintaining standard heights from floor to cushion top (even with extra-thick cushions); of preventing the opening up of an unsupported area at the lower end of the subject's back when sitting in loose-pillow-back styles; of preventing unsightly cushion-gap at the front end of loose cushion styles; and of providing desired comfort standards in the new, largely loose-cushion, motion-furniture.

Many unsuccessful expedients have been used to ameliorate these conditions. For example, wire grids, half-height continuous coils, or light-gauge, standard-arced springs, pulled down flat enough to meet the installation necessities, have been employed. Unfortunately, they have resulted in hard, inferior seats, whose only yield is in the cushion and not in the spring base (which should be the major source of both yield and upward buoyancy under load).

A solution to these problems has been elusive. A furniture manufacturer has been faced with mutually contradictory factors which create a very difficult environment for comfortable seating. First, the crown of the seat springs relative to the point of suspension or rail attachment must be lower than that of high-arc springs by a substantial factor, ideally from approximately 1¼" to 1¾" as opposed to 2¼ to 2¾" for high-arc springs. Second, relative to high-arc springs and the three most important factors in luxury seating (initial-drop, deep-drop and upward resilience), the solution, in order to meet these requirements, must have increased initial-drop, less deep-drop, and as nearly as possible the same upward resilience. Third, the solution must provide for closing cushion-gap in both spring-edge and hard-edge furniture.

SUMMARY OF THE INVENTION

An object of the present invention is to provide a spring assembly which solves all of the aforedescribed problems. Another object is to provide, within the strictures and parameters noted, a spring assembly having an entirely unprecedented degree of yield and softness; controlled, increased initial-drop; reduced deep-drop; and substantial uplift.

The foregoing and other objects are obtained by the use of a spring band incorporating an inverted torque-arm having specific angular relationships according to the invention. This inverted torque arm construction is employed adjacent the back rail. It may be coupled with a second inverted torque-arm construction adjacent the front rail to achieve additional superior results, however.

Unexpectedly provided, upon being loaded, is a higher degree of readily yielding initial-drop for softness. Also provided is a lesser degree of ensuing deep-drop. Finally, a desirable amount of upward buoyancy, lift or resilience is provided. The controlled deep-drop and upward buoyance appear to be a function of the transverse compression of the parallels along the axis of the main span as the overturned moment or half-moment seeks to compress the band when a subject is seated, exerting a forward-tending force (in forms with a rear torque arm only), and a forward-and-backward tending force (in forms with both rear and front torque arms). In either case, the combination of the vector forces of the moment or moments generate the performance attributes needed to meet the unusual requirements of the trendy new furniture. A very strong torsioning is developed in the parallels at the point of upward lift even though the point of band suspension (for rail-attachment) remains at the rail-top. The net arc height, relative to the rail tops, is substantially lowered.

A final short leg extends from the upper end of the inverted torque arm, at back, or back and front, and is attached to a conventional clip on top of the rails to provide free-pivoting action. The leg may include a swing anchor such as disclosed in U.S. Pat. No. 3,790,149, or some other form of linkage.

The torque-arm is joined, integrally at its lower end, to an arced sinuous spring of desired gauge, length, and size of convolution. The spring can be of either standard radius arc, or some lesser degree of arc. The interaction of the forces involved, initial easy downward flexing followed by vector stresses upward due to the conjunction of the moment-arm lifting upward with the upward-seeking nature of the main-span section of the arcuate spring and the downward-seeking nature of its ends, produces the correct dynamics required for luxury and comfort in this type of seat base within the constraints hereinbefore discussed.

The spring assembly constructed according to the invention also produces a highly advantageous relationship between the height of the point of rail attachment and the height of the point of uplift-generation (bends) relative to the top of the rails. The latter is well below the former whereby the profile of the spring assembly is flattened considerably without loss of performance.

DESCRIPTION OF THE DRAWINGS

The invention, including the foregoing and other objects thereof, is illustrated more or less diagrammatically in the drawings, in which.

BRIEF DESCRIPTION OF THE PREFERRED EMBODIMENTS

Figure 1:
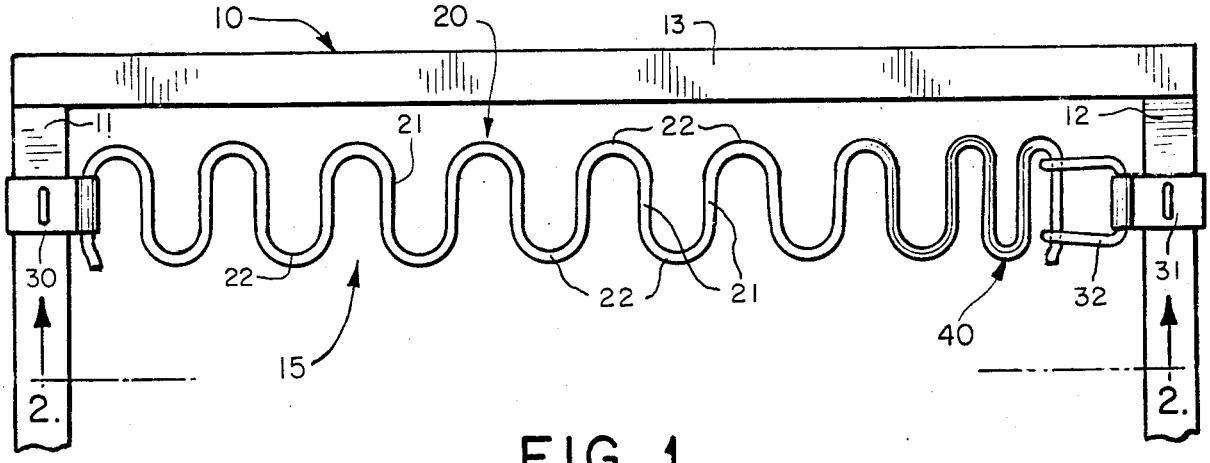
FIG. 1 is a top plan view of a portion of a furniture seat spring assembly embodying features of a first form of the present invention.
Figure 2:
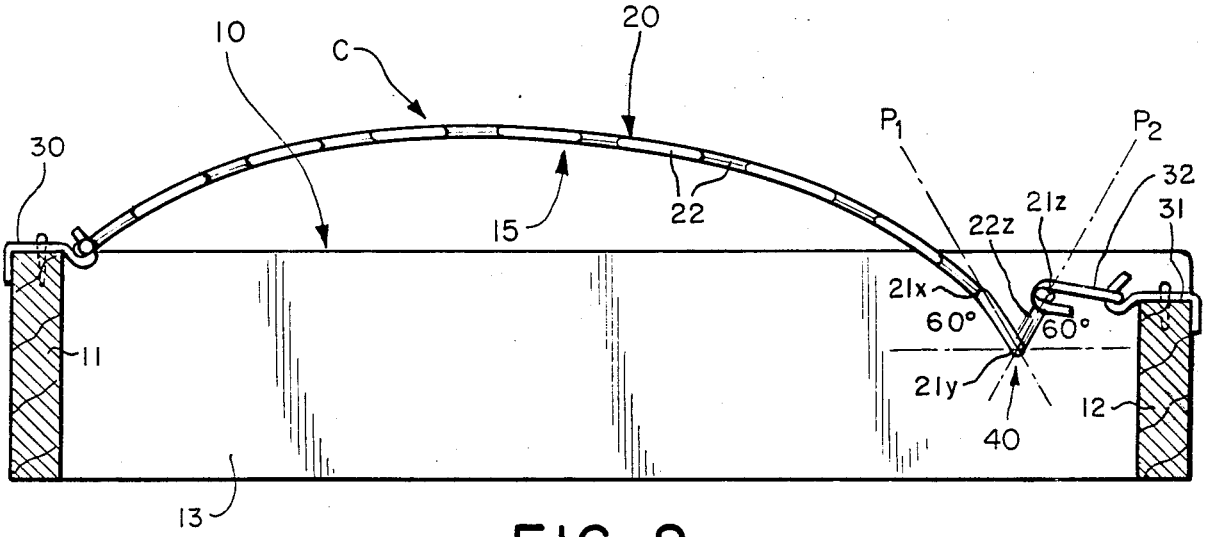
FIG. 2 is a sectional view taken along line 2—2 of FIG. 1.

Referring now to the drawings, and particularly to FIGS. 1 and 2, a portion of a furniture seat is seen generally at 10. The furniture seat 10 includes a front rail 11 and a back rail 12 interconnected by side rails 13 (only one shown). Each of the rails 11–13 is fabricated of wood, in the present illustration, and assembled in a conventional manner. The top of the back rail 12 is 1″ lower than the top of the front rail 11.

Mounted between the front and back rails 11 and 12, and parallel to the side rails 13, are a series of seat spring assemblies 15 embodying features of a first form of the present invention (only one shown). The seat spring assembly 15 includes an extended, regular loop sinuous spring band 20 of normally arced configuration. As has previously been pointed out, however, although the embodiments of the invention illustrated and described herein each utilize a regular loop sinuous spring band, the invention also contemplates the use of X-L bands, superloop bands, or some other arced sinuous band configuration.

Figure 6:
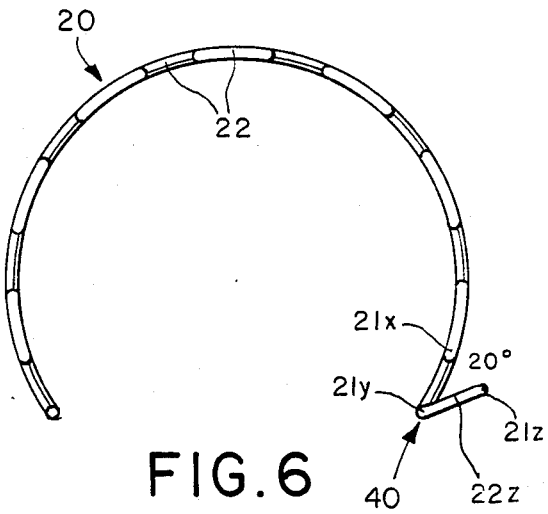
FIG. 6 is a side elevational view of a relaxed, sinuous spring band of the type employed in the first form of seat spring assembly illustrated in FIGS. 1–3.

The extended, regular loop band 20 includes a plurality of parallel linear wire segment 21 conventionally spaced approximately 2.25 centimeters apart and interconnected by generally semi-circular wire segments 22. The band 20 forms a circle, or portion thereof, in relaxed form, as seen in FIG. 6, which in use is extended into the profile illustrated in FIG. 2 and secured to the rails 11 and 12 in a manner hereinafter discussed.

In the assembly 15 the extended sinuous spring band 20 is pivotally seated on the front rail 11 in a conventional EKS clip 30. The forwardmost linear segment 21*a* of the band 20 seats in the clip 30 in a well known manner.

The extended spring band 20 is pivotally connected to the back rail 12 by a swing anchor 31 of the type illustrated in FIG. 1 of U.S. Pat. No. 3,790,149, assigned to the same assignee as the present invention. The swing anchor 31 is, in turn, seated in another conventional EKS clip 32. The last or ultimate wire segment 21*z* at the back end of the band 20 is seated in the swing anchor 31 and the anchor 31 is seated in the clip 32, both in a well known manner.

According to the invention, a torque arm 40 is formed in the back end of the extended band 20 adjacent its connection to the rail 12. The torque arm 40 is inverted, i.e., it extends downwardly from the swing anchor 31. As a result, when a subject is seated there is a substantial initial drop in the body of the band 20. Only a modicum of deep drop is experienced, however. Nevertheless, there is a substantial uplift under the seated subject when he or she arises.

In the bend complex 40 illustrated in FIGS. 1 and 2, the extended band 20 drops to a point 1″ to $1\frac{1}{4}$″ below the level of the top of the back rail 12, as defined by the position of the EKS clip 32, to a nadir at the second rearmost linear segment 21*y*. At this point, which is the locus for the leverage achieved in the manner hereinafter discussed, the plane $P_1$ defined by the third and second linear segments 21*x* and 21*y* is inclined at an angle of approximately 60 degrees to the horizontal.

From the nadir locus at the linear segment 21*y*, the last semi-circular segment 22*z* of the band 20 in the torque arm 40 extends upwardly to the last linear segment 21*z*, which is seated in the swing anchor 31. The plane $P_2$ defined by the second and first linear segments 21*y* and 21*z* (as well as the semicircular segment 22*z*) is also inclined at an angle of approximately 60 degrees to the horizontal.

The body of the band 20 curves in a continuous arc forwardly and upwardly from the nadir locus at the linear band segment 21*y* to a zenith point or crown approximately three-fifths of the distance between the back rail 12 and the front rail 11, closer to the front rail. At the crown C, the band 20 is $1\frac{1}{4}$″ to $1\frac{3}{4}$″ above the level of the top of the rail, i.e., the level of the EKS clip 30.

From the crown C, the arc of the band 20 curves in its continuous arc downwardly to the front rail clip 30, as seen in FIG. 2. In the alternative, referring to FIG. 3, it may terminate in another swing anchor 31*a*, identical to the aforedescribed swing anchor 31, but connecting the forwardmost linear segment 21*a* of the band 20 to the front rail EKS clip 30.

The band 20 is extended in FIGS. 1 and 2 from its relaxed form seen in FIG. 6, as previously pointed out. The band 20 is, in the present illustration, normally arced, regular sinuous of the type manufactured by the No Sag Spring Division of Lear-Siegler, Inc. The band 20 in the present illustration is 20″ long. It is curved into the major segment of a circle having a radius of $3\frac{3}{4}$″$\pm\frac{1}{4}$″ in its relaxed state prior to installation. The torque arm 40, as defined by the linear segments 21*y* and 21*z* and the semicircular segment 22*z* of the band 20, defines approximately a 20 degree included angle with the body of the band.

When the band is stretched between the rails 11 and 12 the radius of the band is increased to about 14″. The tendency of the band to return to its small diameter configuration puts a substantial amount of force on the linear segment 21*y*, where the torque arm 40 and the body of the band 20 are joined together, whereby when installed the torque arm 40 is pulled outwardly to the point where a approximately 60 degree angle exists between the torque arm and the body of the band.

In operation of the spring assembly 15 embodying the first form of the invention, as mounted in FIGS. 1 and 2, the crown C of the band 20 starts out $1\frac{1}{4}''$ to $1\frac{3}{4}''$ above the front rail 11, as has been pointed out. As a subject is seated, the swing anchor 31 swings downwardly in the "initial drop" mode. The inverted torque arm 40 arrangement encourages this initial drop rather than opposing it in any way.

As pressure from the subject increases, and the band 20 continues down, pivoting about its forwardmost linear segment 21*a*, the operation of the band assembly 115 permits a modicum of "deep drop" but opposes a substantial amount adjacent its crown C. Past the limit of initial drop the subject is, in effect, compressing the band longitudinally while, at the same time, increased pull on the torque arm 40 is translated into an increased urging of the band 20 upwardly by the torque arm 40. Thus, further downward movement or "deep drop" of the spring band occurs but is restricted.

Meanwhile, increased resilience is building up in the spring band 20 as a product of the longitudinal compression caused by the increased force exerted by the subject being seated, and the operation of the torque arm 40, constantly increasing its force tending to urge the spring back upwardly. The result is substantial uplift or upward resilience in the "uplift" mode.

Figure 4:
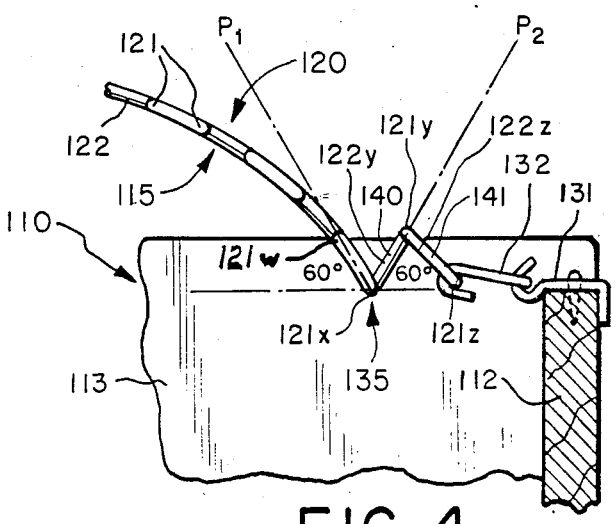
FIG. 4 is another view similar to FIG. 2 illustrating a second form of seat spring assembly embodying features of the present invention, with parts removed.

Turning now to FIG. 4, a portion of another furniture seat is seen generally at 110. The furniture seat 110 includes frame rails, of which only back rail 112 and one side rail 113 are shown, constructed and arranged identically to those in the seat base 10 of FIGS. 1 and 2.

Mounted between the front rail (not shown) and the back rail 112, parallel to the side rail 113 (only one shown), are a series of seat spring assemblies 115 embodying features of a second form of the present invention (only one shown). The seat spring assembly 115 includes an extended, regular loop sinuous spring band 120 of normally arced configuration. Again, however, it might alternatively be fabricated of X-L bands or super-loop band material.

Figure 7:
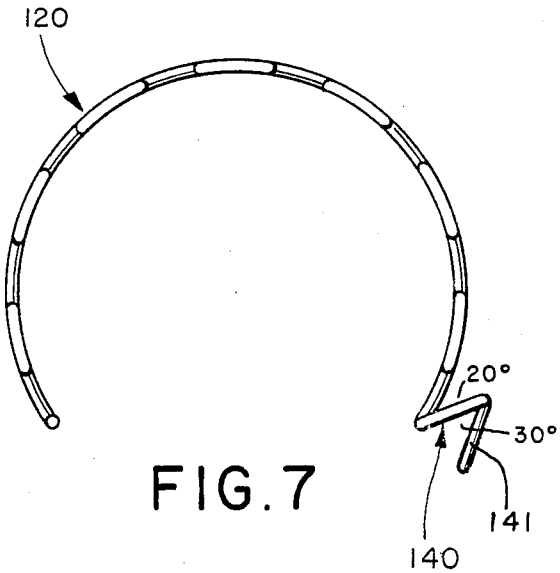
FIG. 7 is a view similar to FIG. 6 illustrating a relaxed, sinuous spring band of the type employed in the second form of seat spring assembly illustrated in FIG. 4.

The parallel linear wire segments 121 of the band are interconnected by generally semicircular wire segments 122. Again the band 120 forms a circle, or portion thereof, in relaxed form, this time as seen in FIG. 7, and in use is extended into the profile illustrated in part in FIG. 4 and secured to the front rail (not shown) and the back rail 112 in a manner hereinafter discussed.

In this form of the invention the extended sinuous spring band 120 is pivotally seated on the front rail in a manner identical to that illustrated in FIG. 2. In other words, the forwardmost linear segment of the band 120 seats in an EKS clip in a well known manner. In the alternative, however, again referring to FIG. 3, the forwardmost linear segment may be connected to the front rail through a swing anchor.

The extended spring band 120 is pivotally connected to the back rail 112 by a swing anchor 131. The swing anchor 131 is, in turn, seated in a conventional EKS clip 132. The last or ultimate wire segment 121*z* at the back end of the band 120 is seated in the swing anchor 131 and the anchor 131 is seated in the clip 132, both in a well known manner.

According to the invention a torque arm complex 135 is formed in the back end of the extended band 120, adjacent its connection to the back rail 112. The torque arm complex 135 includes a torque arm 140 which is inverted. In this-regard, the torque arm 140 extends downwardly from an inclined translatory member 141 formed of the back linear segments 121*y* and 121*z* and the back semicircular segment 122*z*. Translatory member 141 is, in turn, connected to the back rail 112 through the clip 132, the final linear segment 121*z* being seated in the clip.

In the bend complex 140 the extended band 120 again drops to a point 1" to $1\frac{1}{4}''$ below the level of the top of the back rail 112, as defined by the position of the EKS clip 132, to a nadir at the third rearmost linear segment 121*x*. At this point, which is the locus for the leverage defined in the manner hereinafter discussed, the plane $p_1$ defined by the fourth and third linear segments 121*w* and 121*x* is inclined at an angle of approximately 60° to the horizontal.

From the nadir locus at the linear segment 121*x*, the penultimate semicircular segment 122*y* of the band 120 in the bend complex 135 extends upwardly to the penultimate linear segment 121*y*. The plane $p_2$ is defined by the third and penultimate linear segments 121*x* and 121*y* (as well as the penultimate semicircular segment which they bracket, segment 122*y*) and is also inclined at an angle of approximately 60° to the horizontal.

The translatory member 141 hereinbefore referred to is inclined downwardly toward the back rail 113 and its connection with the swing anchor 131. In its extended, installed relationship the translatory member 141 forms an angle of approximately 45° with the horizontal.

In its relaxed form, as seen in FIG. 7, the band 120 has a circular profile, as previously pointed out. A radius of $3\frac{3}{4}'' \pm \frac{1}{4}''$ is again defined. The torque arm 140 defines approximately a 20 degree angle with the body of the band 120. The translatory member 141, in turn, defines approximately a 30 degree angle with the torque arm 140.

In operation of the spring assembly 115 embodying features of the second form of the invention, the swing anchor 131 swings downwardly in the "initial drop" mode when a subject is seated. The translatory member 141 permits even further "initial drop" to take place before substantial resistance to further drop is experienced by the subject being seated and the "deep drop" mode of the spring assembly's action begins.

In the "deep drop" mode the downward force of the subject being seated compresses the band 120 longitudinally against its normal opposition to that compression and against the action of the torque arm 140 urging the body of the band upwardly. The use of the translatory member 141 results in the upward force exerted by the torque arm 140 being fed in slowly at first and then more rapidly. A softer seat results initially. Deep drop occurs but again is limited.

Figure 3:
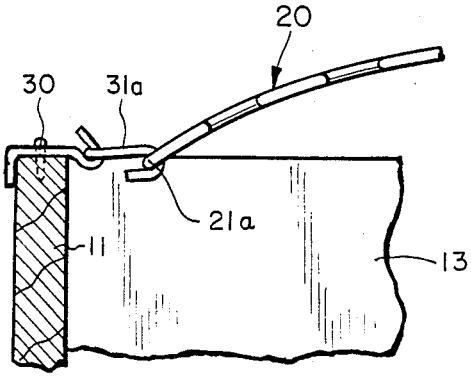
FIG. 3 is a view similar to FIG. 2 illustrating a modification of the first form illustrated in FIGS. 1 and 2.

Upward resilience builds up in the band 120. This translate into substantial resilience under the seated subject, i.e., comfort. When the subject rises an "uplift" or upward thrust assists.

Where a front rail swing anchor connection is employed with either of the first two forms of the present invention, as illustrated in FIG. 3, initial drop occurs at both front and back. The effect of the torque arm at the back rail is actually increased so "uplift" is also increased. This construction is employed only with softedge or compressible molding hard-edge furniture is concerned.

Figure 5:
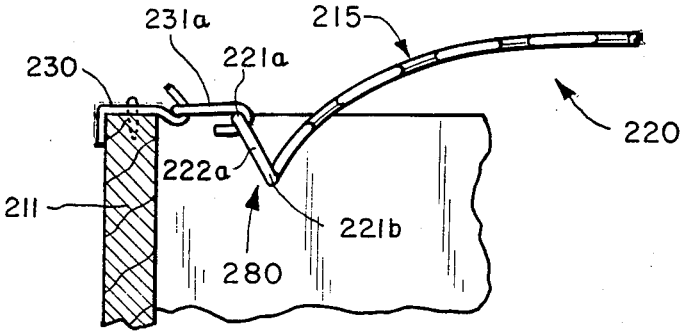
FIG. 5 is another view similar to FIG. 2 illustrating a third form of seat spring assembly embodying features of the present invention with parts removed.

A third form of the invention is embodied in a seat spring assembly 215 illustrated in FIG. 5. Here the assembly 215 includes an inverted torque arm 280 adjacent the front rail 211. The band 220 is constructed and arranged adjacent its front end in a manner identical to the construction of the aforedescribed band 20 adjacent its back end. The inverted torque arm 280 is formed upwardly from the body of the band 220 in the forwardmost and second linear segments 221*a* and 221*b*. They bracket the forwardmost semicircular segments 222*a*, of course.

The forwardmost linear segment 221*a* is connected to the front rail 211 by a swing anchor 231*a*. The swing anchor 231*a* is pivotally seated in a front rail EKS clip 230.

As is readily apparent, only the front half of the spring assembly 215 is illustrated. The back half of the assembly 215 is identical to that illustrated in FIG. 2. A frame pitch of 1", downwardly, is again provided between the front rail 211 and the back rail (not shown).

In installed relationship the spring assembly 215 has a flatter profile across the middle of the body of the band than the assembly 15 seen in FIG. 2. This is as a direct result of the use of a front torque arm 280. The construction makes it even easier to maintain standard height from floor to cushion top where extra-thick cushions are desirable.

With the spring assembly 215 torque generated by the front torque arm 280 and the back torque arm (see FIG. 2) compress the band segments 221 inwardly as a subject is seated and generates downward (and thus outward) force. The assembly 215 provides exceptional "initial drop" and limited "deep drop" followed by upward resilience stronger than that generated in the spring assembly of FIG. 2, for example.

Figure 8:
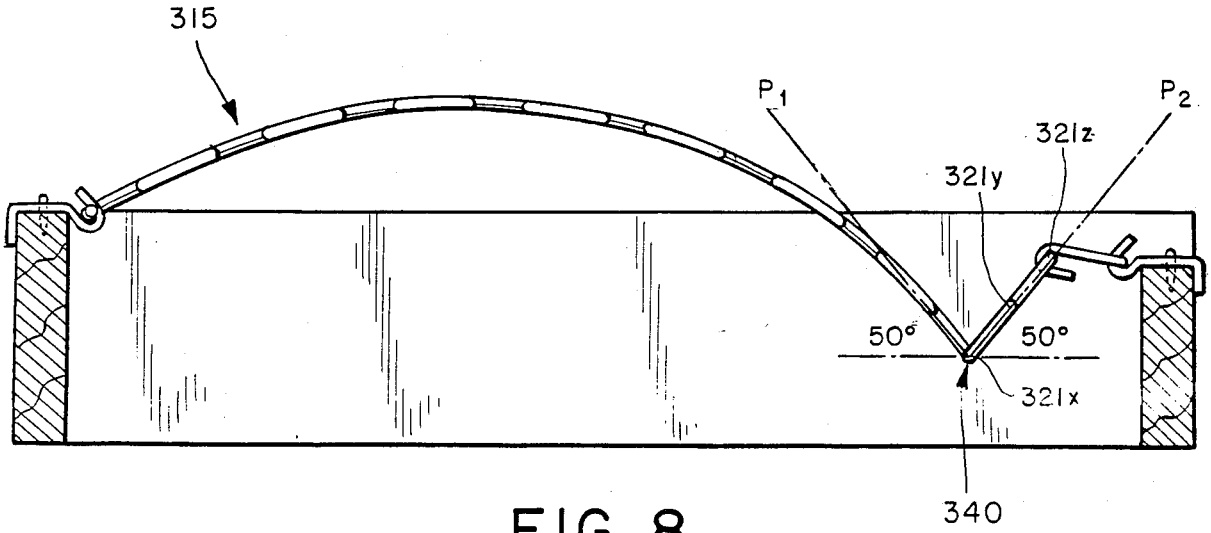
FIG. 8 is a view similar to FIG. 2 illustrating a fourth form of seat spring assembly embodying features of the present invention.

A fourth form of the invention is embodied in a seat spring assembly 315 illustrated in FIG. 8. The assembly 315 is identical to the assembly 15 hereinbefore discussed except that its torque arm 340 is longer. In the assembly 315 the torque arm 340 includes the rearwardmost linear segment 321*z*, the penultimate linear segment 321*y* and the next rearwardmost linear segment 321*x*. It is the latter which defines the lower end of the torque arm 340.

In the assembly 315, the planes $P_1$ and $P_2$ are inclined at somewhat lesser angles. Approximately 50 degrees from the horizontal is what normally results in both cases.

The assembly 315 produces a very soft seat. Exceptional "initial drop" and less uplift are its principal operational characteristics. It finds most advantageous application where the cushion foam employed is more "boardy," i.e., stiffer and less yielding.

While several embodiments described herein are at present considered to be preferred, it is understood that various modifications and improvements may be made therein, and it is intended to cover in the appended claims all such modifications and improvements as fall within the true spirit and scope of the invention.

What is claimed is:

1. An improvement in a furniture seat spring assembly for mounting between the front rail and the back rail of a seat base frame, comprising:

(a) a normally arced, unitary sinuous spring band including a plurality of linear wire segments interconnected by a series of generally semicircular wire segments;

(b) said band being stretched from (an) its normally arced, relaxed form into an extended, lesser arced stressed form whereby a forwardmost linear segment is adjacent the front rail and a rearwardmost linear segment is adjacent the back rail;

(c) means pivotally connecting said forwardmost linear segment to the front rail and said rearwardmost linear segment to the back rail; and (d) torque means formed in said band adjacent the back rail;

(e) said torque means including a torque arm with its lower end defined by a linear segment spaced from said rearwardmost linear segment and an upper end defined by a linear wire segment closer to said rearwardmost linear segment than said lower end;

(f) said band including a main body portion extending in a continuous arc upwardly from said linear segment defining the lower end of said torque arm to a crown which is closer to the front rail than to the back rail.

2. The improvement in a seat spring assembly of claim 1 further characterized in that:

(a) said means pivotally connecting said rearwardmost linear segment to the back rail includes separate link means pivotally mounted on the top of said back rail.

3. The improvement in a seat spring assembly of claim 2 further characterized in that:

(a) said means pivotally connecting said forwardmost linear segment to the front rail includes separate link means pivotally mounted on the top of said front rail.

4. The improvement in a furniture seat spring assembly of claim 1 further characterized in that:

(a) said torque arm is formed upwardly out of the main body of said spring band;

(b) an angle of approximately 60 degrees being defined between said torque arm and said main body where said torque arm and main body meet.

5. The improvement in a seat spring assembly of claim 1 further characterized in that:

(a) said torque arm includes at least three linear wire segments and two generally semicircular wire segments.

6. The improvement in a seat spring assembly of claim 1 further characterized in that:

(a) said torque means includes a translatory member inclined downwardly toward the back rail;

(b) said translatory member including the rearwardmost linear and generally semicircular segment of said spring band.

7. The improvement in a seat spring assembly of claim 1 further characterized by and including:

(a) torque means formed in said band adjacent the front rail;

(b) said front rail torque means including a torque arm with its lower end defined by a linear segment spaced from said forwardmost linear segment and an upper end defined by a linear wire segment closer to said forwardmost linear wire segment than said lower end.

* * * * *